United States Patent [19]

Knippel

[11] 4,278,382

[45] Jul. 14, 1981

[54] DOOR LATCH MECHANISM FOR BOTTOM DUMP HOPPER CAR

[75] Inventor: Willis H. Knippel, Palos Park, Ill.

[73] Assignee: Pullman Incorporated, Chicago, Ill.

[21] Appl. No.: 43,990

[22] Filed: May 31, 1979

[51] Int. Cl.[3] ..... B61D 7/30

[52] U.S. Cl. ..... 414/388; 105/239; 105/243; 105/280

[58] Field of Search ..... 105/241.1, 241.2, 308 B, 105/308 E, 243, 256, 280, 424, 255, 310, 280; 414/375, 376, 378, 337, 388

[56] References Cited

U.S. PATENT DOCUMENTS

| | | | |
|---|---|---|---|
| 1,002,994 | 9/1911 | Ingoldsby | 105/308 B |
| 1,280,152 | 10/1918 | Brown | 105/299 |
| 1,286,593 | 12/1918 | Ingoldsby et al. | 105/310 |
| 1,300,958 | 4/1919 | Hart | 105/255 |
| 1,342,088 | 6/1920 | Campbell | 105/239 |
| 1,342,091 | 6/1920 | Campbell | 105/239 |
| 1,398,675 | 11/1921 | Campbell | 105/243 |
| 1,889,171 | 11/1932 | Campbell | 105/280 |
| 1,916,560 | 4/1933 | Campbell | 105/280 |
| 3,872,796 | 3/1975 | Allen | 105/241.2 |
| 4,062,460 | 12/1977 | Allen | 105/241.2 |

*Primary Examiner*—Richard A. Bertsch
*Attorney, Agent, or Firm*—Richard J. Myers

[57] ABSTRACT

A bottom dump hopper car includes a pair of closure doors interconnected for conjoint movement. One of the doors is provided with a pivoted arm extending toward the center sill and is in operative engagement with a pivoted locking latch. The latch includes a stop and a follower element and is pivotally moved between door opening and closing position by means of a reciprocating actuation rod containing a cam element engagable with the follower element.

10 Claims, 6 Drawing Figures

DOOR LATCH MECHANISM FOR BOTTOM DUMP HOPPER CAR

BACKGROUND OF THE INVENTION

1. Field of the Invention

The present invention generally relates to bottom dump hopper cars with closure doors and a locking mechanism. More specifically the invention relates to a locking mechanism for closure doors including a cam actuated locking or latch member which is movable between opening and closing positions by means of a longitudinally reciprocal member having a cam surface and which is moved by means of a ground actuated cam operating mechanism.

2. Description of the Prior Art

The prior art showing door latching and locking mechanisms for bottom dump hopper cars is replete with ground actuated mechanisms which by means of camming arrangements move longitudinally extending actuating rods supported on the under frame of a railway car for tripping doors to an open position and thereafter locking the same by means of track positioned closing cam arrangements. Various of the prior art devices include outwardly and longitudinally extending link portions which may connect to the inner door by universal connections for opening and closing the same as the actuating bars are moved longitudinally. The present invention is an improvement of these prior art devices in that it includes a simple locking and latching arrangement which is adapted to engage a stop in one position for closing a bottom discharge door in a locking position. The locking arrangement is displaced from locking engagement by means of a pivoted latch member suitably engaged by camming means on a longitudinal actuating bar for providing the locking and unlocking action desired.

SUMMARY OF THE INVENTION

A railway hopper car of the open top type includes on opposite sides of a center sill structure longitudinally spaced hoppers having at their lower ends discharge openings. Each of the discharge openings is controlled by a pair of hinged doors which are moved downwardly and outwardly in swinging relation to a discharge position. The doors are of a type which are interconnected for conjoint movement by an arrangement including vertical stationary links positioned on the inner doors and flexible links connected thereto and connected to the outer door. Door opening and closing operation is controlled by arms hingedly connected to the inner doors these in turn being connected for relative sliding movement to the center sill of the car by means of slide brackets. The arms are provided with end portions which engage the stops of a pivoted lock or latch element to maintain the doors in the locked or closed position. A longitudinally extending actuating member is positioned for reciprocation on the center sill of a car and includes locking stop plates which are engageable with locking recesses of the latch or locking members to prevent their rotation and to maintain the doors in the locked position. Each locking or latching member also includes cam means which projects outwardly and is in engagement with a camming surface provided on the longitudinally extending actuating member. As the actuating member is moved longitudinally the stop on the lower end of the actuating member is moved out of engagement with the stop recess provided on the latch or locking member. Upon such movement the cam on the latch member moves upwardly on the inclined cam surface of the actuating member and thereby provides for hinged upward movement of the locking member thereby disengaging the stop, which has maintained the hinged arm, which is connected to the door in the locked position. Thus the arm is released and the door is adapted to be moved downwardly by the load or lading of the inner surface of the door thus opening the inner door and then providing for the conjoint opening movement of the outer door to completely discharge the load from the hopper of the car.

DESCRIPTION OF THE PREFERRED EMBODIMENT

Figure 1:
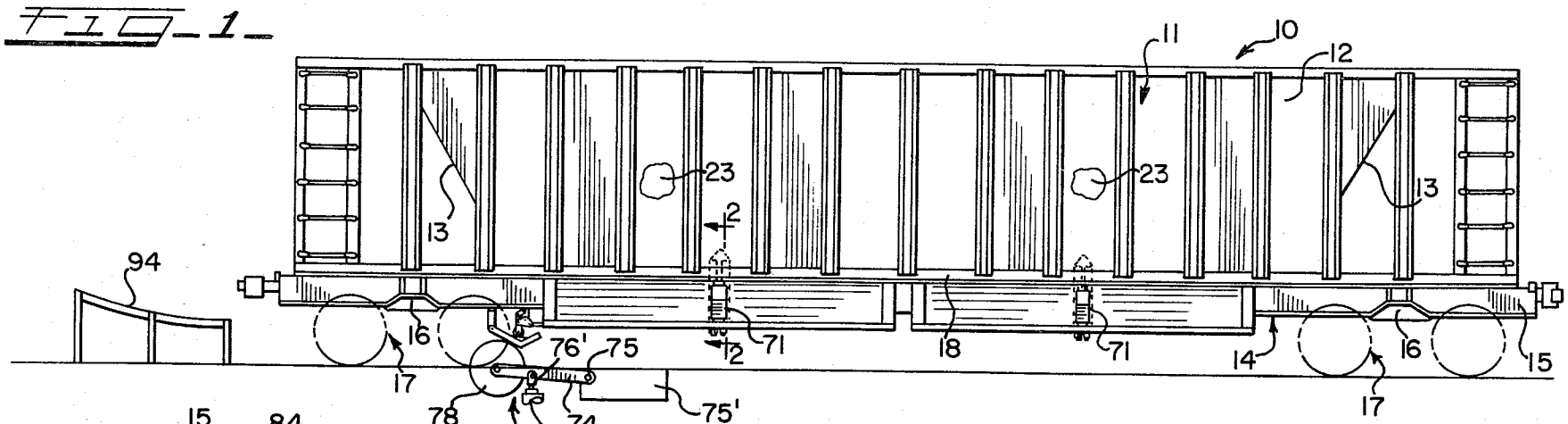
FIG. 1 is a side elevational view of a hopper car embodying the present invention.
Figure 2:
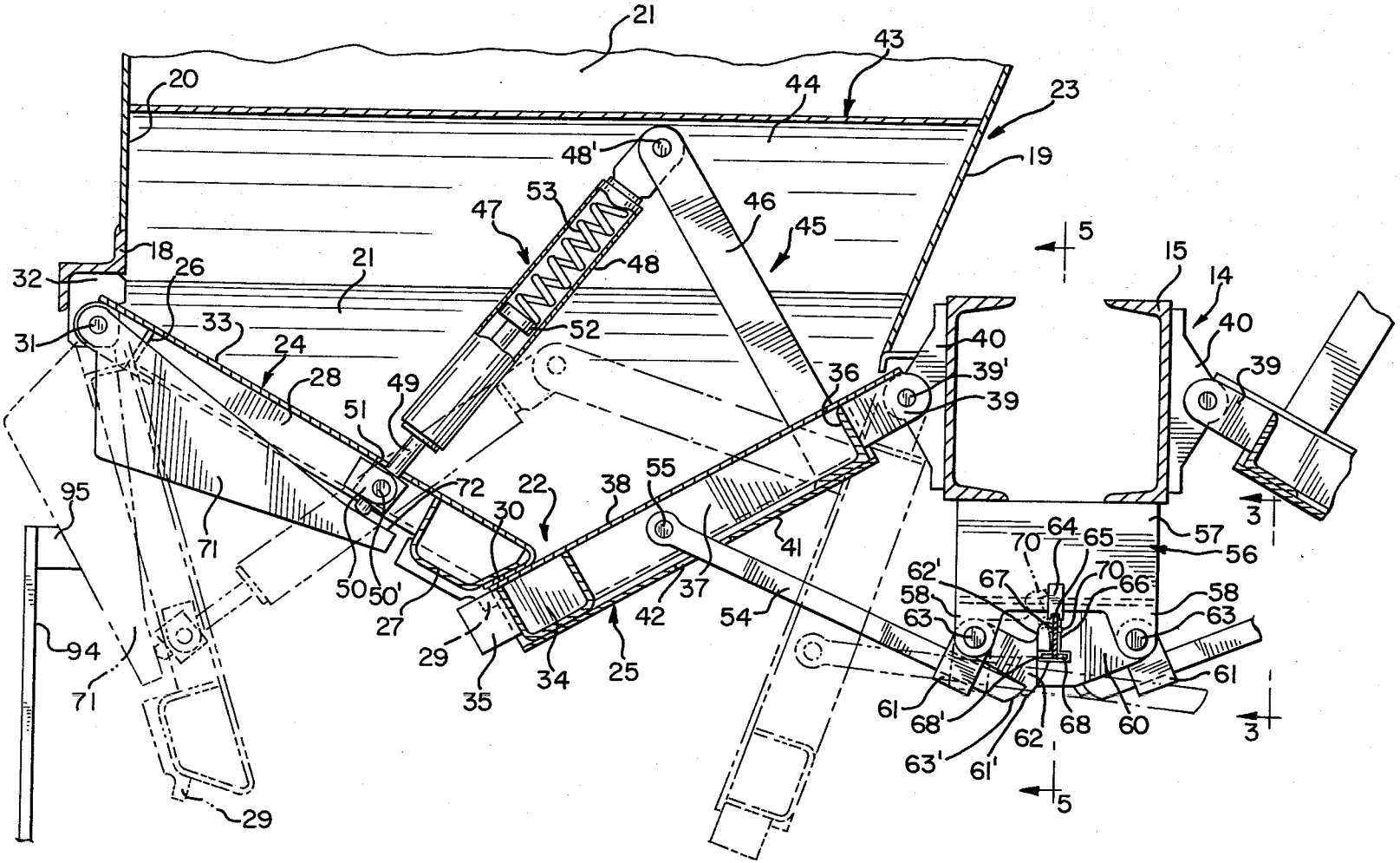
FIG. 2 is a cross-sectional view taken substantially along the line 2—2 of FIG. 1.

FIG. 1 discloses a railway hopper car 10 which includes a car body 11 having side walls 12 and end walls 13. The body 11 is supported on an underframe 14 comprising a center sill 15 containing at opposite ends car bolsters 16 which are suitably supported on wheel trucks 17. The car includes side sills 18 which support the side walls 12 and the body 11. A plurality of hopper structures 23 are positioned on opposite sides of the center sill 15 in longitudinally spaced relation. Each of the structures 23 includes vertical hopper walls 21 and longitudinally extending vertical slope sheets 19, which with lower portions 20 of the side walls 12 providing for a lower portion of the hopper structures which includes a discharge opening 22. Thus a total of four hopper structures are provided on the present car 10 and each includes a pair of door structures including outer doors 24 and inner doors 25. The outer doors 24 include, as best shown in FIG. 2, longitudinally extending structural members 26 and 27 and vertically extending and longitudinally spaced transverse members or gussets 28. The inner portion of the outer door 24 is provided with a nose portion generally designated at 30. Hinge members 31 hingedly connect the outer door 24 to hinge brackets 32 these in turn being firmly connected to the side sills 18. The outer door 24 also includes an upper door panel 33. The inner door 25 includes longitudinally extending structural members 34 of U-shaped channel construction. The U-shaped channel 34 includes outwardly extending brackets 35 which are adapted to receive projections 29 extending outwardly from the nose 30 to assist in the interconnection of the doors during their closed position as best shown in FIG. 2. The inner door 25 also includes a longitudinal extending angle support 36, the supports being connected to the U-shaped channel 34 by means of a plurality of transverse members or gussets 37. A door support panel member 38 is suitably connected to the upper ends of the transverse and longitudinal members. The inner door 25 is mounted for hinged movement by means of hinge brackets 39, a hinge pin 39', to hinge brackets 40 in turn suitably supported by the center sill 15. The inner doors 25 also each include a lower plate portion 41 having a recess 42.

Each of the hopper structures 23 is provided with a transversely extending hood generally designated at 43 which includes walls 44 extending downwardly vertically to approximately the height of the side sills 18 to provide for clearance of the linkage members 45, 46 and 47 as best shown in FIG. 2. The linkage arrangement 45 includes a stationary link 46 rigidly connected to the inner doors 25. A flexible or outer door link 47 includes a tubular piston casing 48 pivotally connected to the upper end of the link 46 by means of a pivot member 48'. The casing 48 extends downwardly and diagonally and a piston rod 49 extending into the casing 47 is provided with a piston 52. The other end of the piston rod 49 is connected to a pivot block 50 connected to the door 24 by means of a pivot member 50'. The piston rod 49 extends through an opening 51 provided in the panel 33. The piston 52 holds captive a spring 53 which continually urges the piston 52 downwardly relative to the door 24.

Figure 3:
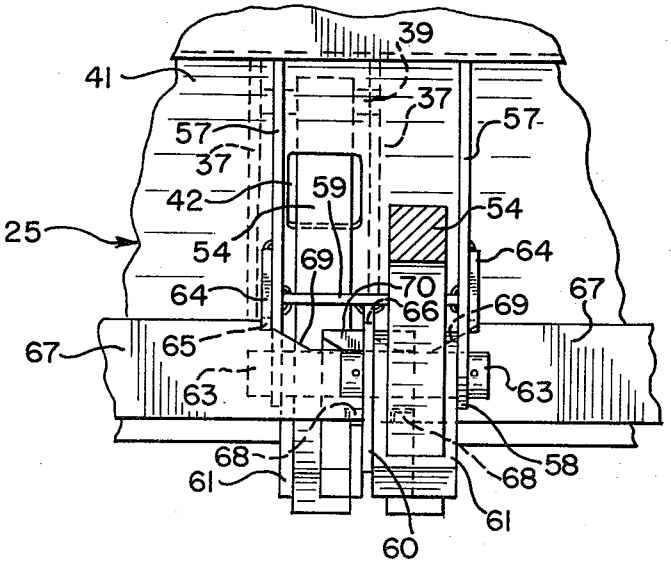
FIG. 3 is an end elevational view taken substantially along the line 3- -3 of FIG. 2 showing portions in section.
Figure 5:
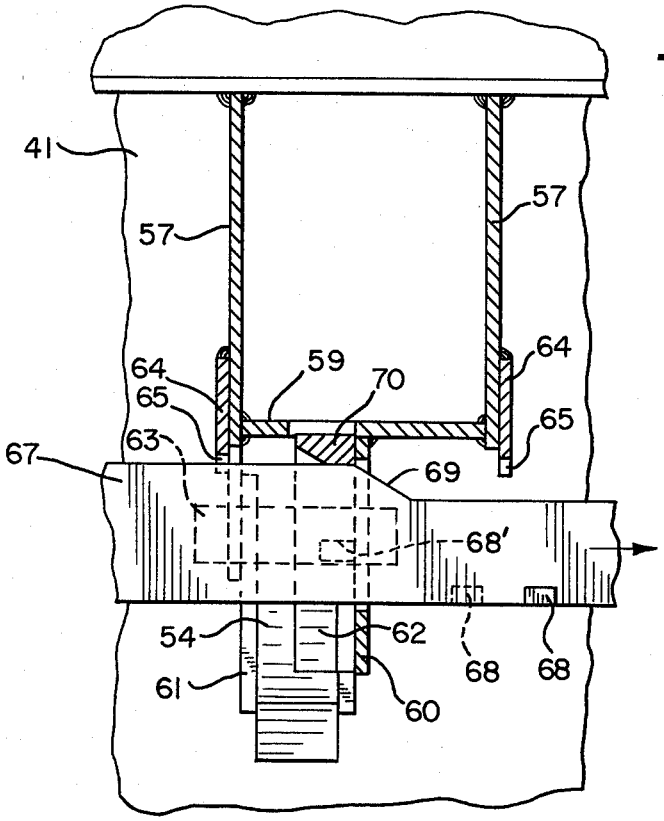
FIG. 5 is an enlarged cross-sectional view taken substantially along the line 5—5 of FIG. 2.
Figure 6:
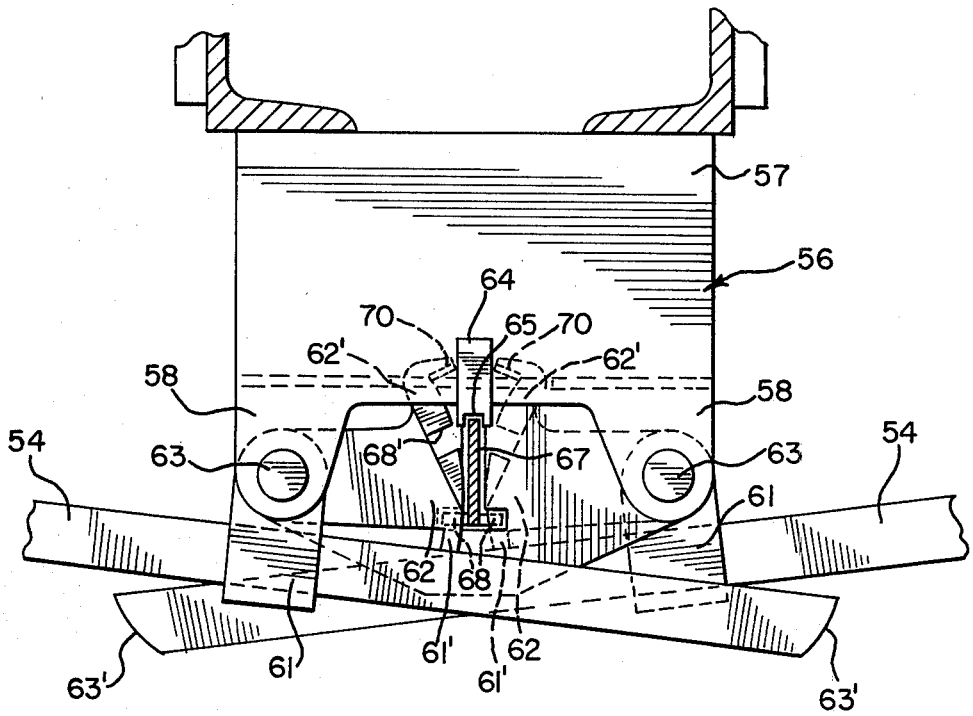
FIG. 6 is an enlarged sectional view showing the center sill of the car and the latch and locking mechanism for controlling the discharge doors.

As best shown in FIG. 2 the inner doors 25 have connected thereto arms 54 pivotally connected as indicated as 55 and extending downwardly and inwardly toward the center sill 15. As best shown in FIGS. 2, 5, and 6 each of the pairs of side-by-side doors includes support brackets 56 which as best shown also in FIGS. 5 and 6 include upright walls 57 having at their lower ends downwardly projecting ears 58. The walls 57 are interconnected by a horizontal wall 59 and a downwardly or vertically extending central lower wall 60 is connected midway on the horizontal wall 59. The innermost ends of the arms 54 are in sliding engagement with slide guides or collars 61 in turn pivotally connected to the pivot members 63. As best shown in FIGS. 2, 5 and 6 rotatable lock members 62 are provided with upwardly projecting necks 62' which include outwardly extending cam projections 70. Each of the latch elements 62 include, below the cams 70, stop recesses 68' which are engaged by plates or stop members 68 provided at the lower ends of a longitudinally extending actuating bar 67. The actuating bar 67 is movable longitudinally in an inverted T-shaped slot 66 provided in the central wall 60. As best shown in FIGS. 3 and 5 the actuating bar 67 is provided with cam surfaces 69 which extend from a substantially horizontal configuration, upwardly and diagonally, to the upper ends of the bar 67'. The cam projections 70 of the latch member 62 are slidable on the surfaces 69 horizontally and upwardly whereupon they are displaced during longitudinal movement of the actuating bar 67 to a disengaged position as best shown in FIGS. 5 and 6. The actuating bar 67 which is of relatively thin inverted T-shaped plate construction is movable through the T-shaped slot 66 and is guided therein by means of vertical guide 64 supported on opposite sides of the support brackets 56 as best shown in FIGS. 3–6. The ends of the arms 54 are provided with stop surfaces 63' which are shown engaged with stop member projections 61' on lock members 62. As best shown in FIGS. 1 and 2 the outer doors 24 have adjacent thereto hinged levers or arms 71 which are hingedly connected to the hinge arrangement 31 and which are able to pivot with the doors 33. The lever or arm 71 are provided with engaging surfaces 72 as best shown on the left hand in FIG. 2 which engage the ends of piston rods 49 and thereby are adapted during upward swinging movement to exert a force thereon.

Figure 4:
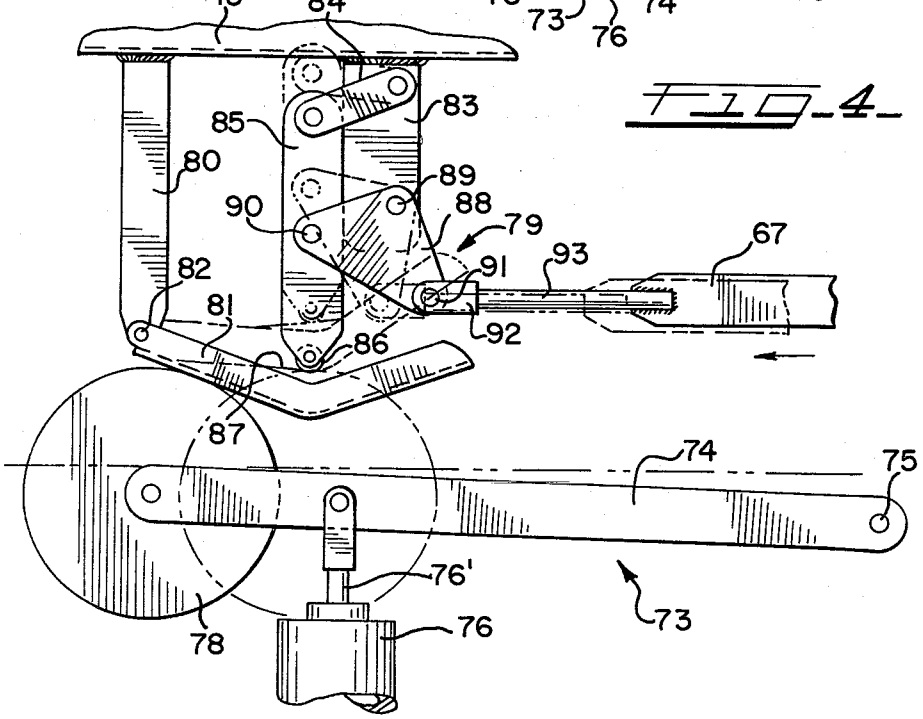
FIG. 4 is an enlarged side elevational view of a track positioned actuating member and camming mechanism for providing longitudinal reciprocation of an actuating door opening mechanism.

As best shown in FIGS. 1 and 4 a ground mounted actuating device is designated at 73 and includes a link or lever 74 pivotally connected as indicated at 75 to a suitable support 75' shown on the ground for relative hinging movement. The link 74 is movable by means of a fluid extensible device 76 connecting thereto by means of a piston rod connection 76'. The device 76 is suitably supported on the right of way by means not disclosed. A roller 78 is mounted on the end of the piston rod 76' and is adapted to actuate a cam and link actuating mechanism 79 mounted on the car structure as best shown in FIG. 4.

The mechanism 79 comprises a vertical post structure 80 which is connected to the center sill 15 and projects downwardly with respect thereto. A cam 81 is pivotally supported at 82 to the post 80 and is adapted to be engaged by the roller 78 when the railway car rides in proximity to the ground mounted actuating mechanism 73. A support 83 projects downwardly from the center sill 15 and a link 84 is pivotally connected to the support and to a vertical moving link 85. The link 85 is provided at its lower end with a roller 86 which is engaged by a projecting surface 87 on the cam member 81. The cam member 81 pivots upwardly around the pivot 82 as determined by the engagement of the roller 78. As the cam 81 clears the roller 78 it is suitably supported on downward swinging movement to a limited degree by means of a stop structure not disclosed. The vertically movable arm 85 also is connected to a bell crank lever 88 by means of a pivot 90 and the lever is also connected by a pivot 89 to the vertical support 83. The lever 88 is also pivotally connected as indicated at 91 to a clevis 92 in turn connected to a rod 93 fixed to the actuating bar 67 to reciprocate the same.

OPERATION

As the railway car shown in FIG. 1 moves to its dumping position at the destination it moves along the track until the dumping pit beneath the track is reached. At this point the ground mounted actuator 73 is actuated and the fluid extensible device 76 pivots the lever 74 upwardly and the roller 78 into engagement with the underneath surface of the cam member 81 moving the same into engagement with the roller 86 which provides for vertical movement of the arm 85 into the dotted line position shown and thereby pivoting the bell crank 88 to move the actuating bar 67 in the direction of the arrow. As best shown in FIGS. 2 and 3 the doors are retained in the closed position since the arms 54 have their ends 63' in locked engagement with the stops 61' of the rotatable lock 62. This is the locked engagement prior to the actuating bar 67 being moved to an open position. In this lock position as best shown in FIG. 3 the stops 68 are disposed in the slots 68' of the rotatable lock member 62 and thus a second locking means is provided to prevent the operation of the lock member 62. However, as the actuating bar 67 is moved in the direction of the arrows shown in FIG. 4 the bar 67 is moved, whereupon the cam projection 70 rides upwardly on the surface 69 and the cam projection 70 on which the cam surface 69 is provided, is moved to a disengaged position. Upon movement of the latch members 62 to this position the arms 54 are now free to move toward the dotted line position shown in FIG. 2 whereupon the doors are opened conjointly and the load is discharged. This opening movement is provided by the weight of the lading within the hopper against the doors urging the same to its open position. Door closing cams 94 are provided along the track and these as best shown in FIG. 2 are engaged by the levers 71 which are forced inwardly into engagement with the piston rods 49 and the doors 24 returning the doors to the closed position. The fluid actuating members 76 and bell crank lever 88 is suitably connected to spring-biasing means (not shown) again returning the actuating rod 67 to the closing position shown in FIG. 2, the latch member 62 having been returned to the position shown and being engaged in the locking position by means of the stop member 68. The doors on the opposite sides of the car are similarly opened by a trackside device 73 which moves the actuating members in an opposite direction when the opposite side is to be unloaded.

What is claimed is:

1. In a railway hopper car including an underframe, a hopper structure supported on said underframe and including a hopper discharge opening, closure means for said opening including inner and outer door assemblies, each assembly including spaced interconnected longitudinal and transverse frame members and a material support panel, hinge means supporting said doors on said car for inward and outward movement relative to said opening, linkage means connecting said inner and outer doors providing for conjoint movement of said doors, the improvement of a locking mechanism for said doors comprising:

an arm connected to said inner door, a support bracket connected to said underframe, means movably connecting said arm to said support bracket, a locking member pivotally connected to said support bracket, said locking member including a stop in one position engaging said arm to maintain said doors in a closed position, a cam member on said locking member, an actuating bar including a cam surface, said cam member being in sliding engagement with said cam surface, and means for reciprocating said actuating bar whereby said cam member is moved on said cam surface to a position wherein said stop is disengaged from said engagement with said arm and said doors are free to move to their open position.

2. The locking mechanism in accordance with claim 1, and:

said linkage means including an upright stationary link on said inner door, and a outer door link pivotally connected to said upright link and pivotally connected to said outer door.

3. The locking mechanism in accordance with claim 2, and:

said outer door link including a tubular piston casing link member, a piston and rod assembly reciprocally positioned within said tubular piston casing link member, and a spring held captive within said tubular piston casing link member and abutting said piston.

4. The locking mechanism in accordance with claim 1, and:

said means movably connecting said arm to said support bracket including a slide guide receiving said arm in sliding relation.

5. The locking mechanism in accordance with claim 4, and:

said actuating bar including a stop member for engaging said locking member to restrain the same against pivoted movement when the inner and outer door assemblies are in the closed position.

6. The locking mechanism in accordance with claim 4, and:

said stop member on the actuating bar including a projection, and said locking member having a stop recess engaged by said stop member in said closed position of said doors.

7. The locking mechanism in accordance with claim 1, and:

said stop recess on said locking member including a recess and projection engaging a portion of said arm.

8. The locking mechanism in accordance with claim 1, and:

said actuating bar including a stop member engaging the locking member when in the closed position to restrain the same against pivoted movement.

9. The locking mechanism in accordance with claim 8, and:

said stop member being movable from the engaged position with said locking member during longitudinal movement of said actuating bar, whereby said cam member moves said locking member to its unlocked position relative to said arm.

10. The locking mechanism in accordance with claim 1, and:

said means for reciprocating said actuating bar includes a ground positioned means, said car having link means adapted to be engaged by said ground positioned means, and means connected to said link means and to said actuating bar for converting vertical motion to horizontal motion to provide for said reciprocation of the actuating bar.

* * * * *